US007083353B2

(12) United States Patent
Venugopalan

(10) Patent No.: US 7,083,353 B2
(45) Date of Patent: Aug. 1, 2006

(54) WRITING PEN WITH BUILT-IN FACILITY FOR CREATING AN EMBOSSED AND METALLIC COATED SURFACE UNDER-LAYER FOR SIGNATURE, TO SECURE ORIGINALITY

(76) Inventor: Chenicheri Vadakkil Venugopalan, 75, Omkar Nagar, Arekere Gate, Bannerghatta Road, Bangalore 560 076, Karnataka (IN)

( * ) Notice: Subject to any disclaimer, the term of this patent is extended or adjusted under 35 U.S.C. 154(b) by 134 days.

(21) Appl. No.: 10/477,737

(22) PCT Filed: Apr. 17, 2003

(86) PCT No.: PCT/IN03/00162

§ 371 (c)(1),
(2), (4) Date: Apr. 13, 2004

(87) PCT Pub. No.: WO03/086778

PCT Pub. Date: Oct. 23, 2003

(65) Prior Publication Data

US 2004/0253043 A1 Dec. 16, 2004

(30) Foreign Application Priority Data

Apr. 18, 2002 (IN) ..... 300/MAS/2002

(51) Int. Cl.

| | |
|---|---|
| ***B43M 11/02*** | (2006.01) |
| ***B05C 1/00*** | (2006.01) |
| ***A47I 11/08*** | (2006.01) |
| ***B31F 1/07*** | (2006.01) |

(52) U.S. Cl. ..... 401/218; 401/17; 401/21; 101/5; 101/22

(58) Field of Classification Search ..... 401/17, 401/18, 21, 218, 195; 101/5, 6, 22, 23
See application file for complete search history.

(56) References Cited

U.S. PATENT DOCUMENTS

| | | | | |
|---|---|---|---|---|
| 1,496,971 | A | 6/1924 | Behrman | |
| 1,574,800 | A | 3/1926 | Duncan | |
| 6,446,549 | B1 * | 9/2002 | Soucie et al. | 101/4 |

FOREIGN PATENT DOCUMENTS

| | | |
|---|---|---|
| AT | 002 070 U1 | 3/1998 |
| WO | WO 01/25025 A1 | 4/2001 |

* cited by examiner

*Primary Examiner*—David J. Walczak
(74) *Attorney, Agent, or Firm*—Foley & Lardner LLP

(57) ABSTRACT

The writing pen creates a background of metallic coated under-layers embossed with strings of impressions on a writing medium. The pen comprises a cartridge with a removable cap connected to the non-writing end of the pen. The cartridge acts as a cylindrical housing for a replaceable sub-cartridge, which stores a coating substance. An out-feeding roller is rotatably disposed, in proximity with the sub-cartridge to receive the coating substance. An intermediate roller is rotatably disposed to receive the coating substance from the out-feeding roller for onward transmission to an embossing and metal coating roller. The embossing and metal coating roller has projections on its surface and is rotatably disposed in the cylindrical housing to generate a unique string of repeated impressions in quick succession on a writing medium. The rollers meshed together to form a gear train to provide a cumulative radial drive to the embossing and coating roller.

9 Claims, 3 Drawing Sheets

9
10
11

19
24
18
14
20
17
16
15

19
18
12
14
17
15
16

21
14
21
14
A
B

WRITING PEN WITH BUILT-IN FACILITY FOR CREATING AN EMBOSSED AND METALLIC COATED SURFACE UNDER-LAYER FOR SIGNATURE, TO SECURE ORIGINALITY

BACKGROUND AND SUMMARY

This invention relates to a writing pen having a built-in facility by the use of which it will be possible to create a special background layer of thin metallic paste (example—gold paste) along with miniature embossed symbols (example—company logo) on paper, so that this under-layer will be used as a background for a signature, by simply signing over it in the normal way by use of the pen.

When a signature has this background of, say, gold along with a miniature embossing on the same, it will prove the originality of the signature, because even the most advanced colour photo-copying or any other advanced scanning or other method cannot reproduce the signature with exactly the same background because the correct golden colour of the actual gold metallic paste will not be reproduced and the miniature embossed symbols, etc. will appear in contrast to the other portions of this background layer, when taking into consideration any reproduction method has to use light reflected off the original surface and such will show embossed portions in contrast as light gets scattered differently compared to the rest of the plain surface. These background changes will not prevent the exact reproduction of the actual signature on the original signed using a normal writing pen, thus ensuring clarity of the signature in all reproduced copies.

This invention achieves the above-mentioned additional built-in facility by incorporating a metal cartridge assembly consisting of several parts into the non-used end of the body of a standard writing pen. This cartridge has a cap, which when removed will expose a roller, which will be used to apply the above-mentioned under-layer on any paper. Once this layer is applied on the paper as desired, the cap is put back and the other end of the pen, which is similar to any standard pen is used in the normal way to sign on this pre-prepared layer.

This results in guaranteeing the security of the original signature, which in turn will guarantee the originality of the document carrying this signature, whenever and wherever copies of the original are made by any of the several advanced copying methods available.

Additionally, this background could also be used to write over them any critical information, which needs to be secured from being altered and copied in the case of any document or letter (example—the value of an item the delivery date, the time, etc.)

One of the main objects of this invention is to provide people with a simple and easy method by which both the sender and the receiver of a written communication can ensure the authenticity and correctness of such information in spite of the possibility of malpractices and misrepresentation increasing with more and more advancements being made in the technology of the reproduction of written communication.

In this digital age, to make optimum use of the IT revolution, it will become imperative sooner than later for every one to think globally and make maximum use of the existing and future developments expected in the field of facilities, such as the internet, e-commerce, e-business, e-governance, e-banking etc., etc.

One of the basic requirements for the above will be for an individual to have a foolproof global identity, which is possible only by assigning a definite 15-digit number by a single global source. The roller described in this invention can accommodate 16 digits.

Once the number is assigned, there will be a need for the individual to reproduce this exact number in each and every one of his dealings with society. There must be an absolutely fool-proof method to ensure this, especially keeping in mind that it will be impossible for anyone to reproduce this number exactly every time from memory. The above-described invention having the engraved roller built into the writing pen ensures this.

Another aspect to be absolutely made sure is that the above-mentioned 15 digit global identity of an individual will be used only by that particular individual and by no one else, intentionally or otherwise. The global ID can become valid only when it is in combination with the individual's superimposed signature. The above-mentioned invention having both the pen and the roller arrangement facilitates this.

Another aspect to be ensured is that first hand reproduction of this global identity by the individual shall be distinctly different from any copy of the same made by the use of any presently available or future copying/scanning techniques. With the use of the above-mentioned invention, the originals as well as the copies will themselves be proclaimed as the original or copy.

Another aspect to be ensured is that there is a foolproof possibility of scanning by electronic means the 15 digits global identity without any ambiguity whatsoever.

Repeated embossed impressions of the global on predetermined standard gold background is possible by using the said invention.

It can be foreseen that this invention, a writing pen with a built-in facility to create an embossed and metallic coated under-layer for signature to secure originality, can become a very effective tool for empowering the digital revolution.

As technology connected with photocopying/scanning and other means of reproduction of original documents is continuously advancing, many attempts have been made in several ways to differentiate the original from their reproduction in one form or another.

Most of the approaches aim at various methods of printing on paper by using special inks or printing using heat-sensitive invisible ink words, such as "void" or "copy" on the original which will show-up on the copies when reproduced or by making use of light gray ink to print certain portions on the document so that the contrast with the white paper background is so lessened that it is not possible to be picked-up in a copy when reproduced (Note—in this case, a person receiving a copy and who has never seen the original will not be in a position to comprehend what is actually missing to identify it as an original or a copy). Some use reflective inks, which distort light in several directions so the copies will not be legible, etc. In other words, most methods serve the purpose by creating a situation where the whole document or a part of it cannot be copied.

One must take into consideration that any document is a written communication originating from a person to another person or persons (from 2 persons to a million people or more!) and the main purpose of a document is to convey a message from the originator to the person or persons receiving the message.

Naturally, the more the number of persons the message is addressed to, more copies of the documents need to be made and, if this is not possible by simple means, such as photocopying, the very purpose of the documents gets negated. Here, it should be mentioned that the very proliferation of photocopying and more advance systems coming into the market itself is proof that documents need to be copied with all its contents as clearly as possible to serve its main purpose.

Now coming to the important features of any document, it should be addressed to someone, it should have some message/information, and it must have the signature of the originator.

The value of any documents even though it may appear to be in its content and the purpose it is meant to serve, a deeper understanding will clearly show that whatever important content it may have the importance really is imparted to the document only on it being signed by the originator. Significantly, the signature is what superimposes the authority/power/wealth of the originator onto the document.

The responsibility for a document whatever its content may be naturally rested on the originator once he affixes his signature on it.

All documents will carry a content, which possibly could be altered without leaving any clear trace of alteration noticeable by human eye. This becomes a case of the original itself being tampered with and mostly could be noticed by an expert and with special equipment available for the purpose.

Another recent, easier, and almost foolproof method is by using the latest advancement in scanning and copying techniques to selectively alter the contents and also superimpose signatures.

Another misuse of documents is the passing of the copies of the original as the original document.

Coming to the point of which portion of the document does a person invariably look to identify an original or a copy or a fake and also assign importance to the document, everyone will agree that one portion of the document, which everyone's eye focuses more than any other portion of the document will be the signature.

So keeping the above-mentioned requirements in mind, an ideal situation will be to find a means by which the signature of the originator will be on a background, which will be of a color and pattern, which will be universally understood easily and, when the document gets copied or reproduced by other means, the color and pattern of the above-mentioned background will change without affecting the clarity of the signature on it.

It will be most ideal when this background could easily be applied and also have the flexibility to be applied at the point of the end of the document (which may be at any portion of the paper) where normally a signature will be located.

It will be still more ideal if the background itself is applied by the concerned person signing the document so that he will be the one to have the power of deciding which document will require such security of being copy-able with clarity but needs to be distinctly differentiated from the original.

Here, it can be mentioned that if the originator of the document so desires or decides that there are certain definite words, sentences, or characters in the documents which needs as much security as the signature than these could also have the above-mentioned background and those words, sentences, or characters can be handwritten on the above-mentioned background by the originator.

Even a more ideal situation will be when the originator, who under all circumstances needs to have a pen to sign the documents also uses the same pen with ease to create this background whenever the originator so chooses.

A still more ideal situation will be when the background layer is created using a unique and prestigious material, which has a universally recognizable colour, texture and uniformity of the same kind controlled and regulated by one universal body, such as the World Gold Council. The material will also add literally "value" to the document and add more reason for preserving the same. A material uniquely qualified to leave a lasting impression will naturally be gold. The original metallic colour of, say, 22 carat gold cannot be copied by any of the present colour photocopying and other present or future processes expected to be developed.

Add to this the possibility of miniature emblems or other marks being simultaneously embossed on the surface as this golden background is being applied, which again will show-up on the copies distinctly as contrast to the changed colour of the original gold coating background on the original document and add to this the possibility of every individual applying this background with a unique pattern of his own depending on how the person chooses to hold the pen as well as making the strokes, in fact, the background will be as unique and individualistic as the signature itself.

After all, there is a trend of people in power and people of wealth carrying very costly and exclusive pens for signing documents, etc., even though, unfortunately, at present there is no way an exclusive pen can leave its mark on the signature. So, a $10,000 pen or a $1 pen will leave an identical signature of ink on the paper.

Any document of any significance will naturally have a sufficiently built-in worth and so no one will mind spending, say, a few dollars of gold paste to create a special background layer for the signature, which will greatly enhance the uniqueness and security of that document.

This invention relates to a writing pen with a built-in facility to create an embossed and metallic coated underlayer for signature, to secure originality. The pen is provided at the rear end with a roller cartridge arrangement in the form of a cartridge, which is attached/connected in any conventional manner to the body of the pen. This cartridge houses the coating substance in a replaceable sub-cartridge and a roller arrangement. The coating substance is a paste made of metals such as gold, which has appropriate qualities to ensure quick drying, non-peeling, clarity, and compatibility with an ink signature and is provided in a container in the form of a replaceable sub-cartridge inside the main cartridge. The main cartridge is a cylinder made of suitable material housing, an assembly of an embossing-cum-coating roller arrangements and a means to store and uniformly supply the coating substance to the coating roller. The replaceable cartridge is a cylinder made of a suitable substance of suitable dimension to be attached in any conventional form inside the main cartridge and to store the coating substance. The roller arrangement consists of a main embossing, a metal coating roller, an intermediate rollers and an out-feeding roller situated in the cartridge such that they are in radial contact in succession. The main embossing and metal coating roller is made of a wear resistant hard material with characters or symbols engraved on the periphery and comes in contact with the paper to create miniature embossed symbols or characters. The intermediate roller is made of a flexible material such as Vulcan rubber, which transfers the coating substance from the out-feeding roller to the main embossing and metal coating roller uniformly. The out-feeding roller is made of a suitable metal, which transfers the coating substance from the replaceable sub-cartridge to the intermediate roller.

DETAILED DESCRIPTION

The present disclosure provides a writing pen to create a background of metallic coated under-layers embossed with strings of impressions on a medium facilitating signature. The embodiments of the present application are explained by referring to the accompanied drawings.

Figures 1, 2, 3, 4:
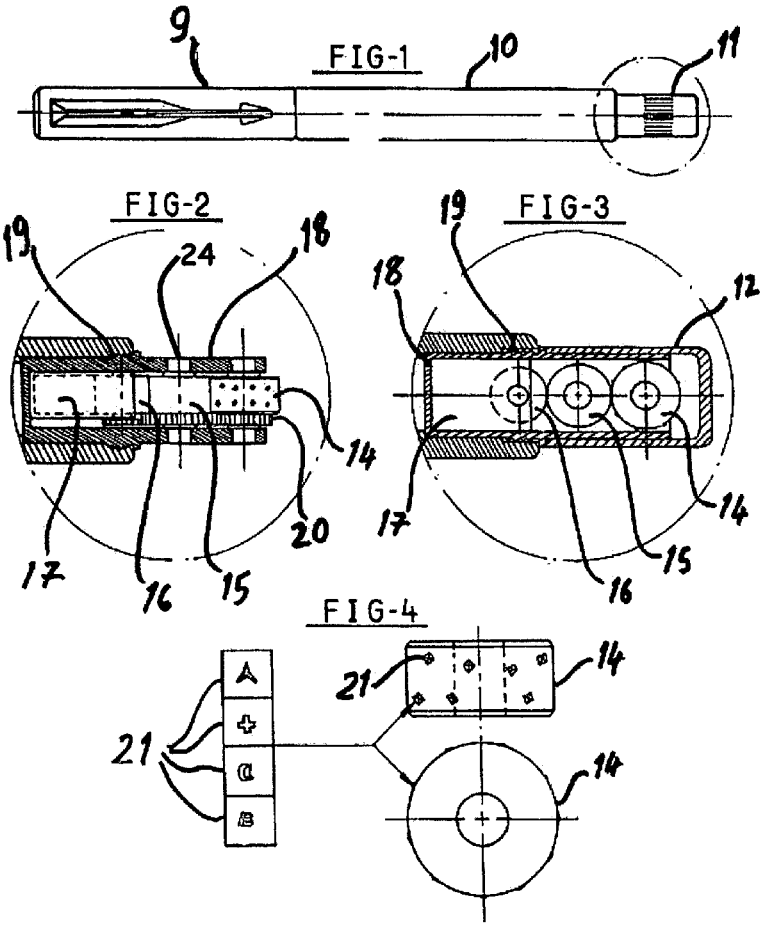
FIG. 1 depicts the writing pen according to an embodiment of the present invention with an built-in facility to create an embossed and metal-coated under-layer.
FIG. 2 is a cross-sectional view of the metal cartridge of the writing pen according to an embodiment of the present invention.
FIG. 3 depicts the metal cartridge along with some portion of the pen body in the form of a cross-sectional view in a different plane of the arrangement.
FIG. 4 provides two enlarged views of the embossing roller with the desired miniature projections.

Initially by referring to FIG. 1, a writing pen of the present disclosure is shown with an built-in facility to create an embossed and metal coated under-layer for signature, to secure originality. Numeral 9 is the normal writing end of the pen. The main body 10 of the pen is shown having the built-in facility in the form of a metal cartridge 11, which is situated at the non-writing end.

The internal construction of the cartridge 11 of the pen of an embodiment of the present invention is now described by referring to FIG. 2. A portion of the non-writing end of the main body 10 of the pen is also shown in cross-section giving a clear picture of the threads 19 used for the fixing of the cartridge 11 to the main body 10 of the pen. In FIG. 2, the cartridge 111 is shown with its cap 12 removed. The cartridge 11 is made up a cylindrical housing 18, which houses various parts inside it, and the cap 12, not shown in this Figure. Numeral 14 is the main embossing and metal coating roller, which projects out of the housing 18. Numeral 15 is the intermediate roller made of a flexible material such as Vulcan rubber, etc. Numeral 17 is the sub-cartridge containing the metal paste along with the metal paste out-feeding roller 16. The three rollers 14, 15 and 16 are situated on shafts 24 such that they are in radial contact in succession. The gear-train 20 interlinks the three above-mentioned rollers.

When the main roller 14, is made to roll on the paper in the form of a pen stroke, it applies a fast drying thin coat of metal paste along with an embossing effect caused by the miniature projections 21 in the form of symbols, etc. These projections 21 also cause positive rolling movement of the roller 14, which in turn will cause the gear-train 20 to function causing the intermediate roller 15, as well as the metal paste out-feeding roller 16 of the sub-cartridge 17 to rotate in a relative rotary movement transferring the metal paste progressively onto the paper.

FIG. 3 shows the metal cartridge 11 along with some portion of the pen body 10 in the form of a cross-sectional view in a different plane of the arrangement. The cap 12 in cross-section can be clearly seen in this FIG.

The constructional features of the embossing and metal coating roller 14 are now explained by referring to FIG. 4. The embossing and metal coating roller is provided with miniature projections 21 to cause the embossing effect on the paper. This FIG. also shows in a representative manner the shapes possible for these miniature projections to leave an exclusive type of embossing on the paper as required.

Figure 5:
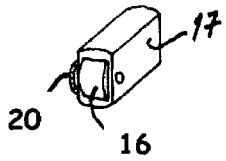
FIG. 5 depicts the sub-cartridge along with the metal paste out-feeding roller and a part of its gear train.

The construction of the sub-cartridge 17 with out-feeding roller 16 is now described by referring to FIG. 5. The sub-cartridge 17 acts as a housing for the out-feeding roller 16. The out-feeding roller is provided with a gear-train 20 to effect a meshing arrangement with the intermediate roller 15. The sub-cartridge 17 contains the appropriate metal paste with a self-ejecting arrangement and will out-feed the metal paste as required by means of the out-feeding roller 16 mentioned above.

Figure 6:
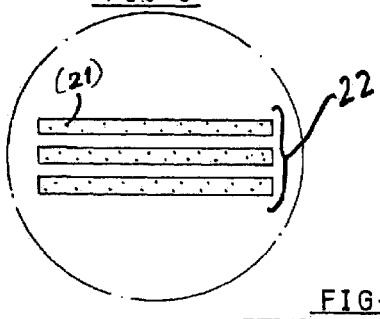
FIG. 6 is a representative picture of the metal coated and embossed under-layer on a paper as a writing medium.

Now, by referring to FIG. 6, a representative picture of the embossed under-layer 22 achieved by using the writing pen according to an embodiment of the present invention is shown.

Figure 7:
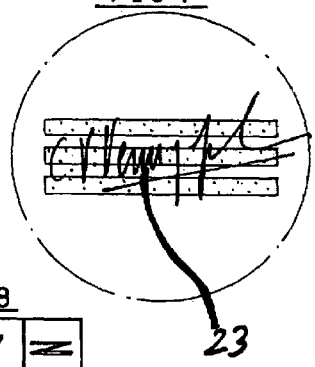
FIG. 7 depicts in a representative way the appearance of a signature made on the embossed and metal coated under-layer.

The appearance of the signature 23 in a representative manner made on the embossed and metal coated under-layer 22 is shown in FIG. 7.

Figure 8:
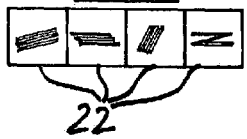
FIG. 8 depicts in a representative manner various individualistic patterns as required for applying the embossed and metal-coated under-layer on paper by use of the appropriate pen strokes by the user.

Now by referring to FIG. 8, various individualistic patterns as required can be created while applying the embossed and metal coated under-layer on the paper by use of appropriate pen strokes by the user, as shown.

Figure 9:
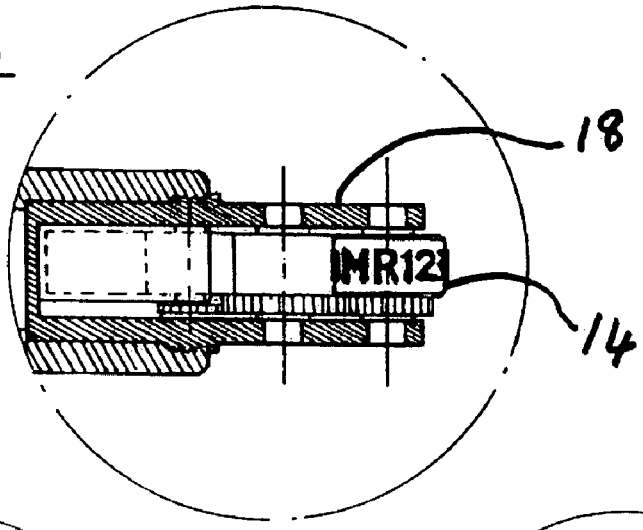
FIG. 9 depicts the same cross-section as in FIG. 2 but with the embossing-cum-coating roller having projections in the form of numerals and letters instead of symbols.

The creation of embossing in the form of numerals and letters by using the embossing and metal coating roller 14 of the writing pen, according to an embodiment of the present invention, is shown in FIG. 9.

Figure 10:
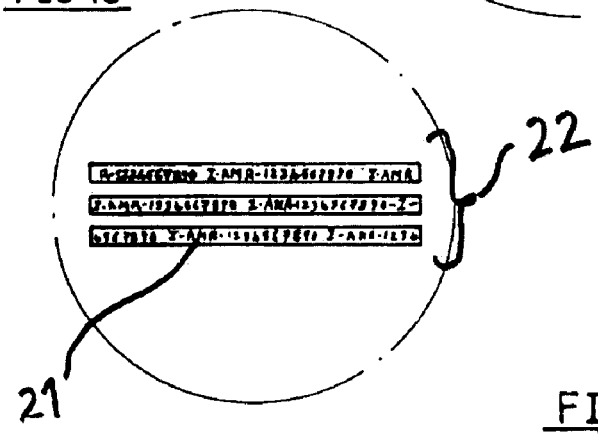
FIG. 10 is a representative picture of the metal coated embossed under-layer on paper as in FIG. 6 but the embossed under-layer has miniature embossed characters in the form of a series of letters and numbers.

FIG. 10 shows a representative picture of the metal coated embossed under-layer 22 on paper, as in FIG. 6, but the embossed under-layer has miniature embossed characters in the form of a series of letters and numbers.

Figure 11:
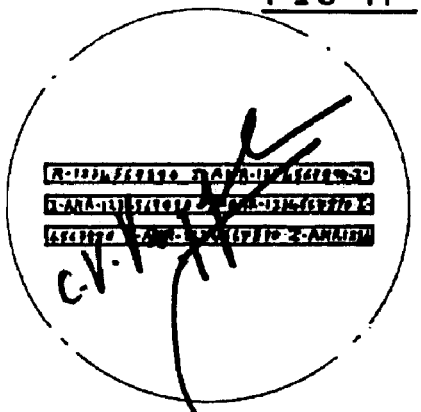
FIG. 11 depicts in a representative manner the appearance of a signature made on the embossed and metal coated under-layer as shown in FIG. 10.

FIG. 11 shows in a representative manner the appearance of a signature 23, made on the embossed and metal coated under-layer 22, as shown and described in FIG. 10.

Figure 12:
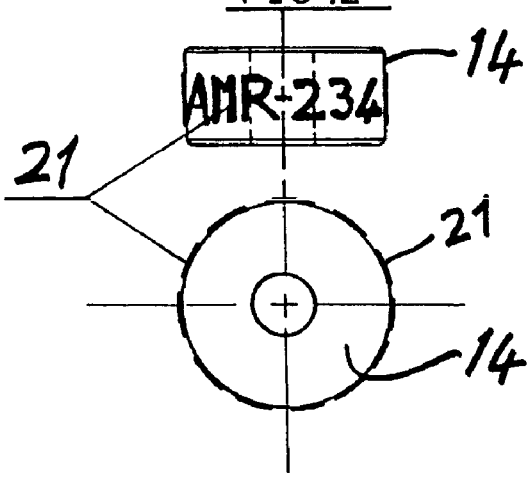
FIG. 12 is two enlarged views of the embossing-cum-coating roller as in FIG. 4 but with the projections on the roller in the form a series of numbers and letters instead of symbols.

FIG. 12 shows the enlarged two views of the embossing-cum-coating roller, as in FIG. 4, but with the projections on the roller being in the form of a series of numbers and letters instead of symbols, as given in FIG. 4.

I claim:

1. A writing pen for creating a background of metallic coated under-layers embossed with strings of impressions on a writing medium, said pen comprising:

(a) a cartridge with a removable cap connected to the non-writing end of said writing pen, said cartridge is disposed to function as a cylindrical housing, (b) a replaceable sub-cartridge for storing a coating substance, said sub-cartridge is housed in said cylindrical housing, (c) an out-feeding roller rotatably disposed in said cylindrical housing, in proximity with the sub-cartridge to receive the coating substance, (d) an intermediate roller rotatably disposed in said cylindrical housing, said intermediate roller is disposed to receive the coating substance uniformly from the out-feeding roller for onward transmission, (e) an embossing and metal coating roller having projections on its surface, said embossing and metal coating roller is rotatably disposed in said cylindrical housing, and (f) wherein the out-feeding, intermediate, and embossing and metal coating rollers meshed together to form a gear train to effect a relative rotary movement when the embossing and metal coating roller is moved over the writing medium and to transmit the coating substance onto the embossing and metal coating roller, wherein said embossing and metal coating roller is further disposed to generate a unique string of repeated impressions in quick succession on the writing medium.

2. The writing pen of claim 1, wherein the coating substance is a substance that is quick drying, non-peeling, clear and compatible with ink.

3. The writing pen of claim 2, wherein the coating substance is gold.

4. The writing pen of claim 1, wherein the out-feeding, intermediate, and embossing and metal coating rollers have independent gears that are in radial contact with each other.

5. The writing pen of claim 1, wherein the out-feeding roller is made of a suitable metal disposed to protrude out of the sub-cartridge and to transfer the coating substance from the sub-cartridge to the intermediate roller.

6. The writing pen of claim 1, wherein the intermediate roller is a soft rubber roller to transfer the coating substance from the out-feeding roller to the embossing and metal coating roller.

7. The writing pen of claim 6, wherein the intermediate roller is made of vulcan rubber.

8. The writing pen of claim 1, wherein the main embossing and metal coating roller is made of a wear resistant hard material with characters or symbols engraved on its surface, to cause a unique string of miniature impressions on the writing medium.

9. The writing pen of claim 1, wherein the writing medium is a paper or any medium compatible with writing in ink and metallic embossing.

* * * * *